US008184085B2

(12) United States Patent
Lee

(10) Patent No.: US 8,184,085 B2
(45) Date of Patent: May 22, 2012

(54) LIQUID CRYSTAL DISPLAY AND METHOD FOR DRIVING THE SAME

(75) Inventor: Byoung-jun Lee, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 899 days.

(21) Appl. No.: 11/495,302

(22) Filed: Jul. 28, 2006

(65) Prior Publication Data

US 2007/0029585 A1 Feb. 8, 2007

(30) Foreign Application Priority Data

Aug. 5, 2005 (KR) ..... 10-2005-0071911

(51) Int. Cl.
*G09G 3/36* (2006.01)

(52) U.S. Cl. ..... 345/99

(58) Field of Classification Search ..... 345/30–105, 345/204–215; 257/72
See application file for complete search history.

(56) References Cited

U.S. PATENT DOCUMENTS 4,649,383 A * 3/1987 Takeda et al. ..... 345/92
4,963,860 A * 10/1990 Stewart ..... 345/206
6,407,729 B1 * 6/2002 Moon ..... 345/99
6,937,224 B1 * 8/2005 Miyachi ..... 345/102
6,980,192 B1 * 12/2005 Matsumura et al. ..... 345/99
2002/0084959 A1 * 7/2002 Park et al. ..... 345/87
2003/0038766 A1 * 2/2003 Lee et al. ..... 345/87
2005/0052368 A1 * 3/2005 Kim ..... 345/76
2005/0057480 A1 * 3/2005 Liao et al. ..... 345/98

FOREIGN PATENT DOCUMENTS

JP 10-068927 3/1998

* cited by examiner

*Primary Examiner* — Chanh Nguyen
*Assistant Examiner* — Allison Walthall
(74) *Attorney, Agent, or Firm* — F. Chau & Associates, LLC

(57) ABSTRACT

A liquid crystal display (LCD) and a method for driving the same include a timing control unit that outputs a first timing signal including a data signal and a load signal and a second timing signal including a gate selection signal and an output enable signal, a delay unit that delays the output gate selection signal by a predetermined period of time, a data driver that converts the data signal into predetermined data voltages according to the load signal and outputs the data voltage, a gate driver that outputs gate-on/off signals according to the delayed gate selection signal, and a liquid crystal panel that displays an image by driving pixel electrodes according to the data voltages and the gate-on/off signals.

7 Claims, 4 Drawing Sheets

LIQUID CRYSTAL DISPLAY AND METHOD FOR DRIVING THE SAME

This application claims priority from Korean Patent Application No. 10-2005-0071911 filed on Aug. 5, 2005 in the Korean Intellectual Property Office, the disclosure of which is incorporated herein by reference in its entirety.

BACKGROUND OF THE INVENTION

1. Technical Field

The present disclosure relates to a liquid crystal display (LCD) and a method for driving the same, and more particularly, to an LCD and a method for driving the same, in which an error is prevented from being generated in gate-on/off signals due to a coupling noise between gate line and data lines.

2. Discussion of the Related Art

LCDs display picture information using electrical and optical properties of liquid crystals injected into a liquid crystal panel and have several advantageous characteristics of thinness, lightness in weight, low power consumption and so on, compared to other electronic products including cathode ray tubes (CRTs). For these reasons, LCDs are extensively used in a wide variety of applications, including display devices such as display monitors for portable computers, desktop computers, HD imaging systems, and the like.

An LCD includes two substrates and liquid crystals having a dielectric anisotropy are injected between the two substrates. Light transmission through the substrates is controlled by varying strengths of electric fields applied to the substrates, thereby controlling the orientation of the liquid crystals and displaying a desired image. In addition, the LCD includes a liquid crystal panel, a timing controller, and a gate driver and data driver for receiving a timing signal from the timing controller and driving the liquid crystal panel. Typically, the liquid crystal panel includes a plurality of gate lines for delivering a gate selection signal, a plurality of data lines intersecting the gate lines and delivering data for each pixel, and a plurality of pixels each formed at an area surrounded by the gate lines and the data line and connected to each other by the gate lines, the data lines and switching elements.

In LCDs, video data is applied to each pixel in the following manner.

First, when gate-on/off signals are sequentially applied to gate lines, switching elements connected thereto are sequentially turned on. At the same time, image signals, that is, gray voltages, which are applied to respective pixel electrodes in a pixel row, are provided to data lines connected to the turned-on switching elements.

The image signals provided to the data lines are applied to each pixel via the turned-on switching elements. In this manner, the gate-on voltages are sequentially applied to all the gate lines to supply pixel signals to the pixels in all the rows during one frame cycle, thereby completing an image for one frame.

FIG. 1 shows waveforms of gate-on/off signals applied to an LCD according to the prior art.

As shown in FIG. 1, when a gate selection signal CPV activates from a low level to a high level upon the application of a vertical synchronizing start signal STV indicating the start of a frame, gate-on/off signals G1, G2, G3, G4, and G5 sequentially activate from a low level to a high level, respectively, and maintain their high levels. Upon the application of a gate output enable signal OE, the gate-on/off signals G1, G2, G3, G4, and G5 are deactivated from their high levels, respectively.

As illustrated in FIG. 2, at an activation time when the gate selection signal CPV makes a transition from a low level to a high level, a load signal TP triggering the start of an output of transmitted video data is deactivated from a high level to a low level. Upon deactivation of the load signal TP, a coupling noise is generated between the data lines and the gate lines. The coupling noise causes a noise in bias voltages $V_{DD}$ and $V_{SS}$ of the switching elements, resulting in an error in the gate-on/off signals.

The generated noise has an influence upon the gate selection signal CPV. For that reason, an abnormal gate selection signal 10 as shown in FIG. 3 is output, resulting in an abnormal gate-on/off signal 20. The abnormal gate-on/off signal 20 directly causes a poor display quality of the LCD. Thus, a method for preventing an abnormal gate selection signal from being generated due to the coupling noise is required.

Korean Patent Publication No. 2003-0016717 discloses a line inversion driving type LCD capable of removing degradation in display quality by adjusting the pulse width of the gate-on/off signals applied to the gate lines. In the disclosed LCD, a gate-on/off signal applied to a current gate line having a polarity different from its immediately previous gate line has a wide pulse width and a gate-on/off signal applied to a current gate line having the same polarity as its immediately previous gate line has a narrow pulse width, thereby solving degradation in display quality caused by a difference between charging characteristics of the gate lines or an increase in the charging time. However, an error in a gate selection signal is generated by a capacitance between the data lines and the gate lines due to a data signal output to the data lines, resulting in degradation in the display quality.

SUMMARY OF THE INVENTION

Embodiments of the present invention provide a liquid crystal display (LCD) and a method for driving the same, in which an error is prevented from being generated in a gate selection signal due to influence from a data signal by placing a predetermined time interval between the gate selection signal and a load signal.

According to an embodiment of the present invention, there is provided an LCD including a data signal and a load signal and a timing signal including a gate selection signal and an output enable signal, a delay unit that delays the gate selection signal by a predetermined period of time, a data driver that converts the data signal into a predetermined data voltage according to the load signal and outputs the data voltage, a gate driver that outputs a gate-on/off signal according to the delayed gate selection signal, and a liquid crystal panel that displays an image by driving a pixel electrode according to the data voltage and the gate-on/off signal.

According to an embodiment of the present invention, there is provided a method for driving a liquid crystal display (LCD), the method including deactivating a load signal for instructing conversion of video data into corresponding data voltages and the output of the data voltages to a data driver, delaying a gate selection signal that controls the output of a gate-on/off signal by a predetermined period of time after deactivating the load signal and activating the delayed gate selection signal, and driving a pixel electrode according to the data voltage and the gate-on/off signal so as to display an image.

BRIEF DESCRIPTION OF THE DRAWINGS

Exemplary embodiments of the present invention can be understood in more detail from the following descriptions taken in conjunction with the attached drawings in which.

DESCRIPTION OF EXEMPLARY EMBODIMENTS

Exemplary embodiments of the present invention and methods of accomplishing the same are described more fully hereinafter with reference to the accompanying drawings. The invention may, however, be embodied in many different forms and should not be construed as being limited to the embodiments set forth herein.

Figure 1:
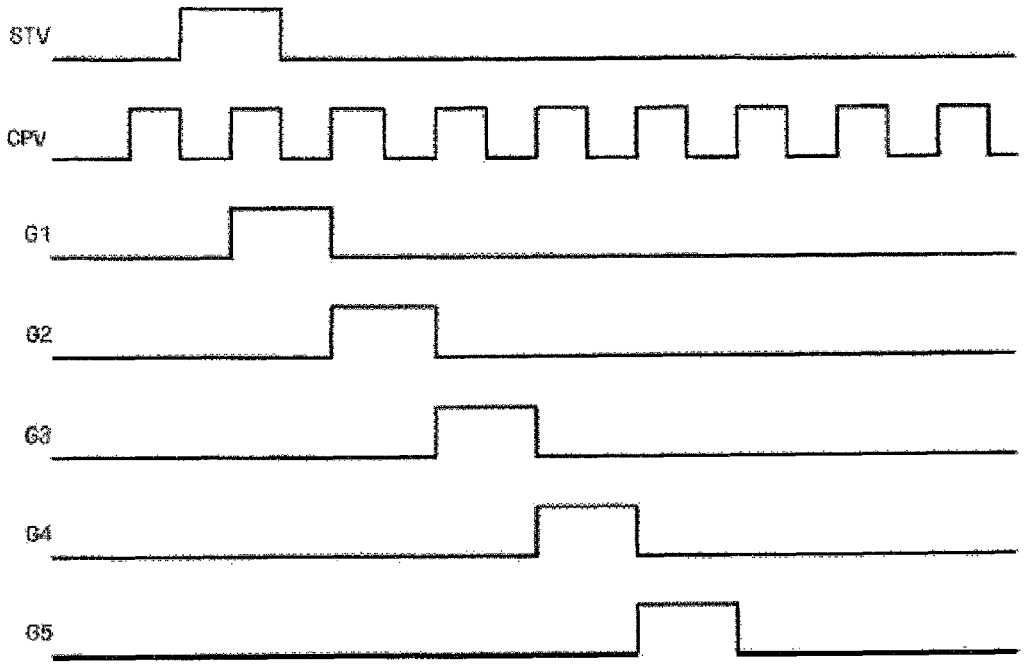
FIG. 1(PRIOR ART)
FIG. 1 shows waveforms of gate-on/off signals of a liquid crystal display (LCD) according to the prior art.
Figure 2:
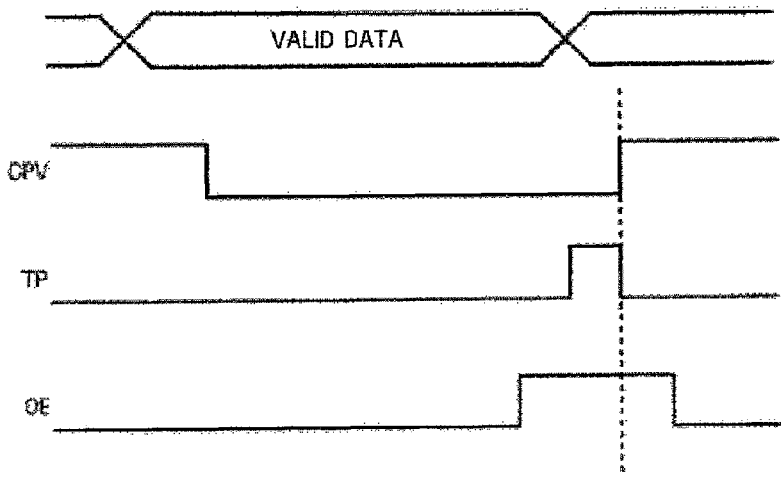
FIG. 2(PRIOR ART)
FIG. 2 shows waveforms of a gate selection signal and a load signal of the LCD according to the prior art.
Figure 3:
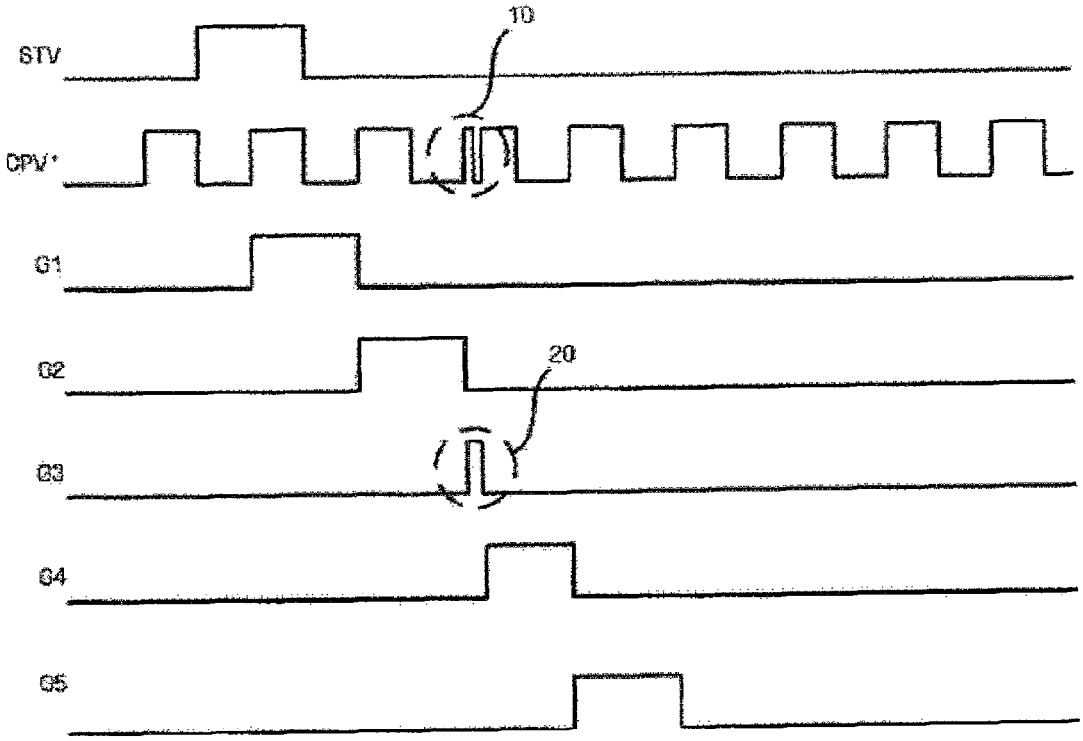
FIG. 3(PRIOR ART)
FIG. 3 shows waveforms of a gate selection signal having an error of the LCD according to the prior art.
Figure 4:
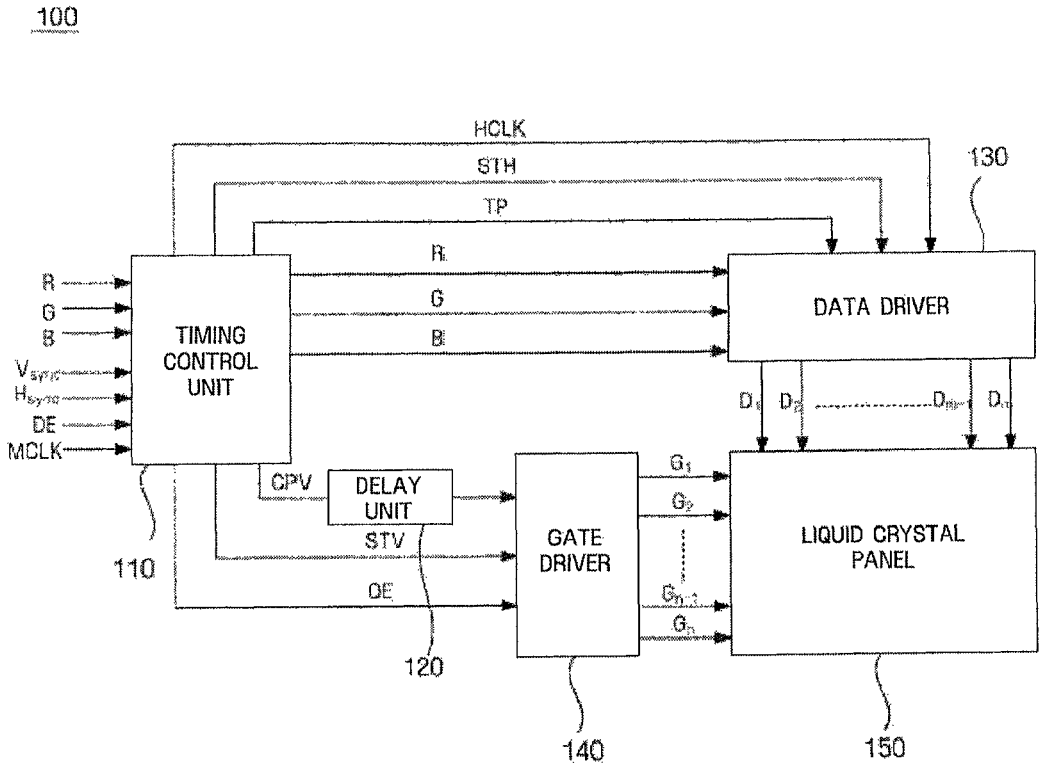
FIG. 4 is a block diagram of an LCD according to an embodiment of the present invention.

FIG. 4 is a block diagram of an LCD 100 according to an embodiment of the present invention.

As illustrated in FIG. 4, the LCD 100 includes a timing control unit 110, a delay unit 120, a data driver 130, a gate driver 140, and a liquid crystal panel 150.

The timing control unit 110 is supplied from an external graphic controller (not shown) with a vertical synchronization signal Vsync, a horizontal synchronization signal Hsync, a main clock MCLK, RGB video data, a data enable signal DE, etc., and generates a first timing signal based on timing signals controlling the display of the RGB video data, for example, the vertical synchronization signal Vsync and the horizontal synchronization signal Hsync. In response to the vertical synchronizing signal Vsync and the horizontal synchronization signal Hsync, the timing control unit 110 sends the generated first timing signal and the RGB video data to the data driver 130. The first timing signal includes a load signal TP for instructing to output the RGB video data to the data driver 130 after transmission of the RGB video data, a horizontal clock signal HCLK, and a horizontal synchronizing start signal STH indicating the start of gate-data lines.

In addition, the timing control unit 110 generates a second timing signal based on the vertical synchronization signal Vsync and the horizontal synchronization signal Hsync controlling the display of the RGB video data and outputs the generated second timing signal to the data driver 140. The second timing signal includes a gate selection signal CPV controlling the output of gate-on/off signals, a vertical synchronizing start signal STV for selecting the first gate line, and an output enable signal OE.

As mentioned above, the delay unit 120 delays the gate selection signal CPV controlling the output of gate-on/off signals by a predetermined time period and then outputs the delayed gate selection signal CPV to the gate driver 140. While the delay unit 120 includes an integrating circuit and a buffer, in the exemplary embodiment of the present invention, the invention is not limited to such a configuration.

When the RGB video data is output from the data driver 130 upon deactivating of the load signal TP from a high level to a low level, as the gate selection signal CPV activates from a low level to a high level, the delay unit 120 prevents an error in the gate-on/off signals due to a coupling noise generated between data lines and gate lines of the liquid crystal panel 150. In other words, the delay unit 120 prevents simultaneous level transition of the gate selection signal CPV and the load signal TP due to a coupling noise between the data lines and the gate lines. Meanwhile, the delay unit 120 may change an activation time of the gate selection signal CPV after a deactivation time of the load signal TP and before a deactivation time of the output enable signal OE. This is because the gate selection signal CPV is delayed only when the output enable signal OE is at a high level, enabling the output of the gate-on/off signals. While the period of time delayed by the delay unit 120 is 0.5 μs in this embodiment of the present invention, the invention is not limited thereto.

The data driver 130 is a source driver including a plurality of data drive integrated circuits. The data driver 130 is supplied with the RGB video data from the timing control unit 110, and it stores the RGB video data in a shift register (not shown), converts the RGB video data into voltages $D_t$, $D_2$, . . . , $D_{m-1}$, $D_m$ upon the application of the horizontal synchronizing start signal STH, and outputs the voltages to a plurality of data lines of the liquid crystal panel 150. In other words, the data driver 130 outputs the RGB video data to the liquid crystal panel 150 upon the input of the horizontal synchronizing start signal STH corresponding to the first through last data lines.

The gate driver 140 is a scan driver including a plurality of gate driver integrated circuits. The gate driver 140 is supplied with the gate selection signal CPV from the delay unit 120 and the vertical synchronizing start signal STV from the timing control unit 110 and sequentially outputs a plurality of gate-on/off signals $G_1$, $G_2$, . . . , $G_{n-1}$, $G_n$ to a plurality of gate lines of the liquid crystal panel 150.

The gate selection signal CPV supplied from the timing control unit 110 is delayed by a predetermined time period by the delay unit 120 and is then transmitted to the gate driver 140. The delay unit 120 can prevent an error from being generated in the gate selection signal CPV due to a noise caused by the data voltages $D_1$, $D_2$, $D_{m-1}$, $D_m$ output from the data driver 130.

The liquid crystal panel 150 includes a plurality of pixel electrodes in an (m×n) matrix form and drives the pixel electrodes in response to the data voltages $D_1$, $D_2$ . . . , $D_{m-1}$, $D_m$ supplied by the data driver 130 upon the application of the gate-on/off signals $G_1$, $G_2$, . . . , $G_{n-1}$, $G_n$ to pixels from the gate driver 140, thereby displaying an image.

Figure 5:
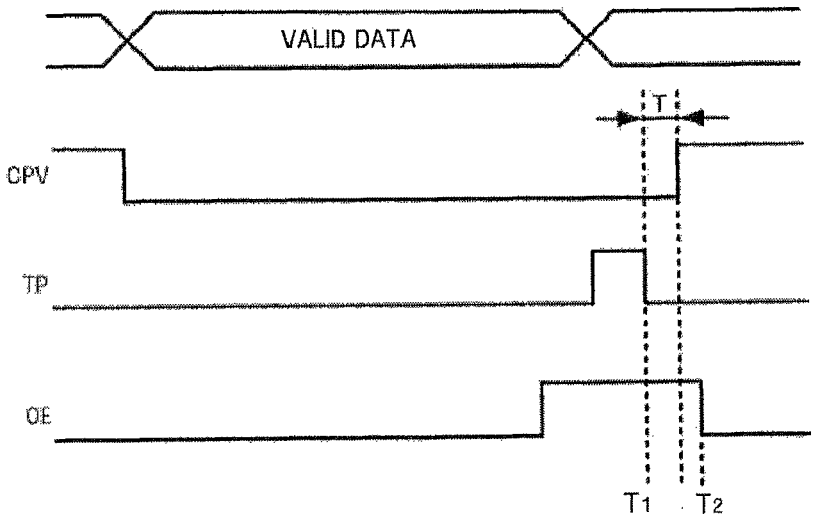
FIG. 5 shows waveforms of a gate selection signal and a load signal of the LCD according to an embodiment of the present invention.

FIG. 5 shows waveforms of the gate selection signal CPV and the load signal TP of the LCD 100 according to an embodiment of the present invention.

As shown in FIG. 5, a high activation of the gate selection signal CPV can be delayed by a predetermined time T between a deactivation time of the load signal TP and a deactivation time of the output enable signal OE.

More specifically, assuming a time at which the load signal TP is shifted from a high level to a high low level is T1 and a time at which the output enable signal OE is shifted from a high level to a low level is T2, a period of time T that can be delayed by the delay unit 120 may be defined as being less than a difference between T1 and T2, that is, T<T2−T1.

In this way, since level shift occurs between the load signal TP and the gate selection signal CPV with a predetermined time interval, it is possible to prevent an error in the gate selection signal CPV due to a coupling noise between the gate lines and the data lines of the liquid crystal panel 150 caused by the data voltages $D_1, D_2, \ldots, D_{m-1}, D_m$ applied to the data lines of the liquid crystal panel 150 from the data driver 130.

Figure 6:
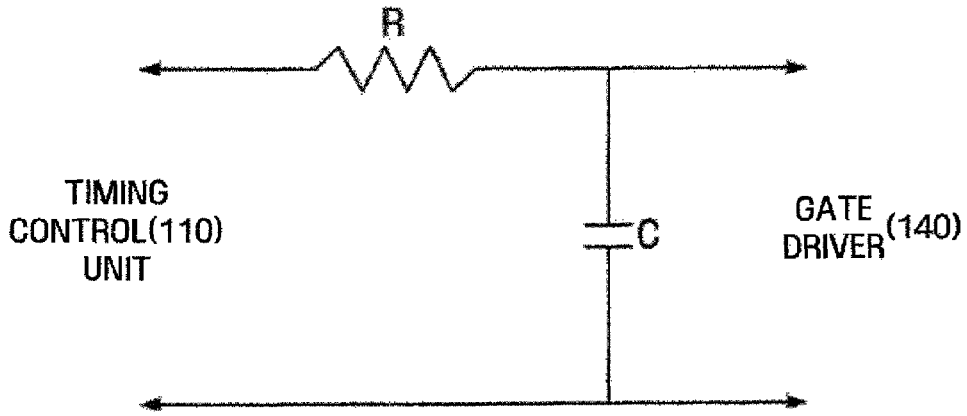
FIG. 6 is a circuit diagram of a delay unit according to an embodiment of the present invention.

FIG. 6 is a circuit diagram of the delay unit 120 according to an embodiment of the present invention.

As shown in FIG. 6, the delay unit 120 according to an embodiment of the present invention may be implemented as an RC integration circuit including a resistor R and a capacitor C connected in parallel, the resistor R having the output port of the timing control unit 110 as an input port. The period of time of the delay may be determined by a time constant determined by the values of the resistor R and the capacitor C. Since the period of time for the delay unit 120 to reach a predetermined output level is determined by the time constant, it can be controlled by adjusting the values of the resistor R and the capacitor C.

While the delay unit 120 includes an integration circuit having passive devices, for example, a resistor, a capacitor, and an inductor, in the illustrative embodiment of the present invention by way of example, it may be implemented as a buffer capable of delaying the output of a signal without being limited thereto.

Figure 7:
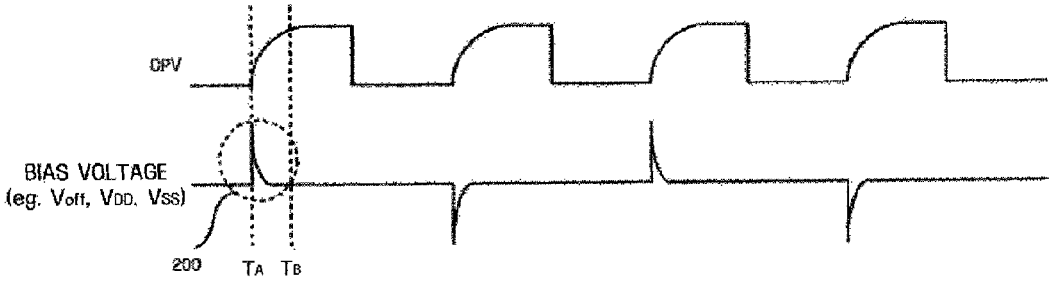
FIG. 7 shows a waveform of a gate selection signal delayed by the delay unit according to an embodiment of the present invention.

FIG. 7 shows a waveform of the gate selection signal CPV delayed by the delay unit 120 of FIG. 6 and a waveform of a bias voltage, for example, Voff, $V_{DD}$, $V_{SS}$, of the liquid crystal panel 150 of FIG. 4, according to an exemplary embodiment of the present invention.

As shown in FIG. 7, if it is determined that the gate selection signal CPV goes high at a time $T_B$, the gate selection signal CPV may be delayed by a time difference between $T_A$ and $T_B$. More specifically, the period of time T delayed may be understood as $T=T_B-T_A$. Thus, the gate selection signal CPV is not affected by a coupling noise shown at 200 between the data lines and the gate lines of the liquid crystal panel 150 during the delayed period of time T, thereby preventing an error from being generated in the gate-on/off signals.

As described above, according to an embodiment of the present invention, by delaying a gate selection signal by a predetermined period of time with respect to a load signal corresponding to the application of data voltages to data lines, it is possible to prevent a coupling noise from being generated between the data lines and the gate lines of a liquid crystal panel due to the data voltages, thereby preventing degradation in display quality.

While the present invention has been particularly shown and described with reference to exemplary embodiments thereof, it will be understood by those of ordinary skill in the art that various changes in form and details may be made therein without departing from the spirit and scope of the present invention as defined by the following claims. Therefore, it is to be understood that the above-described embodiments have been provided only in a descriptive sense and will not be construed as placing any limitation on the scope of the invention.

What is claimed is:

1. A liquid crystal display (LCD) comprising:

a timing control unit that outputs a first timing signal including a data signal and a load signal and a second timing signal including a gate selection signal and an output enable signal, wherein the gate selection signal includes a plurality of pulses in a frame;

a delay unit that delays the gate selection signal by a predetermined period of time;

a data driver that converts the data signal into predetermined data voltages according to the load signal and outputs the data voltages;

a gate driver that sequentially outputs gate-on/off signals, wherein each gate on/off signal is outputted according to the pulse of the delayed gate selection signal; and a liquid crystal panel that displays an image by driving pixel electrodes according to the data voltages and the gate-on/off signals, wherein the delay unit delays activation of the gate selection signal after a deactivation time of the load signal and before a deactivation time of the output enable signal.

2. The LCD of claim 1, wherein delay unit delays the activation of the gate selection signal by 0.5 μs.

3. The LCD of claim 1, wherein the delay unit is implemented as an integration circuit including passive devices.

4. The LCD of claim 1, wherein the delay unit is integrated into the timing control unit.

5. A method for driving a liquid crystal display (LCD), the method comprising:

deactivating a load signal for instructing conversion of video data into corresponding data voltages and the output of the data voltages to a data driver;

delaying a gate selection signal controlling the output of gate-on/off signals by a predetermined period of time after the deactivating of the load signal; and driving pixel electrodes according to the data voltages and the gate-on/off signals and displaying an image, wherein the delayed gate selection signal is activated after deactivating the load signal and before the deactivating of an output enable signal, and wherein the output enable signal is activated before activation of the delayed gate selection signal.

6. The method of claim 5, wherein the activating the delayed gate selection signal is delayed by 0.5 μs.

7. The method of claim 5, wherein the activating the delayed gate selection signal comprises delaying the gate selection signal by an integration circuit including passive devices.

* * * * *